US006939148B2

(12) United States Patent
Yu

(10) Patent No.: US 6,939,148 B2
(45) Date of Patent: Sep. 6, 2005

(54) ELECTRICAL CARD CONNECTOR HAVING AN IMPROVED GROUNDING CONTACT

(75) Inventor: Hung-Chi Yu, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/902,768

(22) Filed: Jul. 30, 2004

(65) Prior Publication Data

US 2005/0026479 A1 Feb. 3, 2005

(30) Foreign Application Priority Data

Jul. 30, 2003 (TW) ..... 92213898 U

(51) Int. Cl.[7] ..... H01R 13/648

(52) U.S. Cl. ..... 439/92; 439/95; 439/607; 200/5 R

(58) Field of Search ..... 439/92, 95, 108, 439/377, 159–160, 607–610, 9, 939

(56) References Cited

U.S. PATENT DOCUMENTS 3,701,071 A * 10/1972 Landman ..... 200/5 R
5,478,260 A * 12/1995 Kaufman et al. ..... 439/609
5,725,394 A * 3/1998 Banakis et al. ..... 439/607
5,967,803 A * 10/1999 Ho ..... 439/79
5,967,813 A * 10/1999 Ho et al. ..... 439/159
6,027,348 A * 2/2000 Lai et al. ..... 439/92
6,074,223 A * 6/2000 Huang ..... 439/95
6,106,309 A * 8/2000 Kakinoki ..... 439/92
6,129,562 A * 10/2000 Hong ..... 439/79
6,162,070 A * 12/2000 Yu et al. ..... 439/108
6,183,271 B1 * 2/2001 Yu ..... 439/79
6,183,273 B1 * 2/2001 Yu et al. ..... 439/92
6,227,879 B1 * 5/2001 Dong ..... 439/92
6,247,967 B1 * 6/2001 Wu et al. ..... 439/607
6,322,392 B1 * 11/2001 Wang ..... 439/607
6,354,876 B1 * 3/2002 Yu ..... 439/607
6,645,010 B1 * 11/2003 Billman et al. ..... 439/608
6,733,310 B2 * 5/2004 Fujikura et al. ..... 439/95
6,773,275 B1 * 8/2004 Chen ..... 439/92
6,805,585 B1 * 10/2004 Ko ..... 439/607
2004/0166707 A1 * 8/2004 Kodera et al. ..... 439/92

* cited by examiner

*Primary Examiner*—Ross Gushi
*Assistant Examiner*—Larisa Tsukerman
(74) *Attorney, Agent, or Firm*—Wei Te Chung

(57) ABSTRACT

An electrical card connector (1) comprises an insulative housing (2), a plurality of contacts (21), (22) received in the insulative housing, a shell (3), an ejector (4), and a retention device (5). The insulative housing defines a plurality of passageways extending therethrough. The contacts includes signal contacts (21) received in the passageways, and a pair of grounding contact (22) being positioned at a rear end of the insulative housing and each having a curved portion (222). The shell is assembled to the insulative housing and comprises a top wall (31), opposite side walls (320), and a pair of grounding portions (35) each extending downwardly from the top wall and connecting with the curved portion of the grounding contact.

2 Claims, 5 Drawing Sheets

ELECTRICAL CARD CONNECTOR HAVING AN IMPROVED GROUNDING CONTACT

BACKGROUND OF THE INVENTION

1. Field of the Invention

The present invention generally relates to an electrical card connector, and particularly to an electrical card connector having an improved grounding contact for preventing electromagnetic interference (EMI).

2. Description of Prior Arts

With the development of portable computer, the dimension of the portable computer gets more and more smaller. At the same time, the computer needs more memory cards to meet the requirement of signal transmission. The electrical card connectors are widely used in the portable computer. However, in order to meet the miniature trend for portable computer, high transmitting speed and highly concentrated arrangement of contacts will result and will cause EMI to influence qualities of signals. U.S. Pat. No. 6,354,876 discloses such an electrical card connector 1 (referring to FIG. 1) having a grounding plate 40. The grounding plate comprises a plurality of tongues 46 extending inwardly and contacting a surface of an electrical card, and a plurality of soldering fingers 44 soldered to grounding path on a printed circuit board (PCB) for eliminating EMI in the surface of the electrical card. However, the grounding plate is made from a metal sheet. When the soldering fingers are soldered on the PCB, the grounding plate will absorb heat and bring about stress concentration. After cooling the grounding plate, the stress will be released to cause deformations and affect grounding quality.

Hence, it is desirable to have an improved connector to overcome the above-mentioned disadvantages of the prior art.

BRIEF SUMMARY OF THE INVENTION

Accordingly, it is an object of the present invention to provide an electrical card connector which has an improved grounding contact to achieve a good electrical connection.

In order to achieve the above-mentioned objects, an electrical card connector includes an insulative housing, a plurality of contacts received in the insulative housing, a shell, an ejector, and a retention device.

The insulative housing defines a plurality of passageways extending therethrough. The contacts include signal contacts received in the passageways, and at a pair of grounding contacts being positioned at a rear end of the insulative housing and each having a curved portion. The shell is assembled to the insulative housing and comprises a top wall, opposite side walls, and a pair of grounding portions each extending downwardly from the top wall and connecting with the curved portion of the grounding contact.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
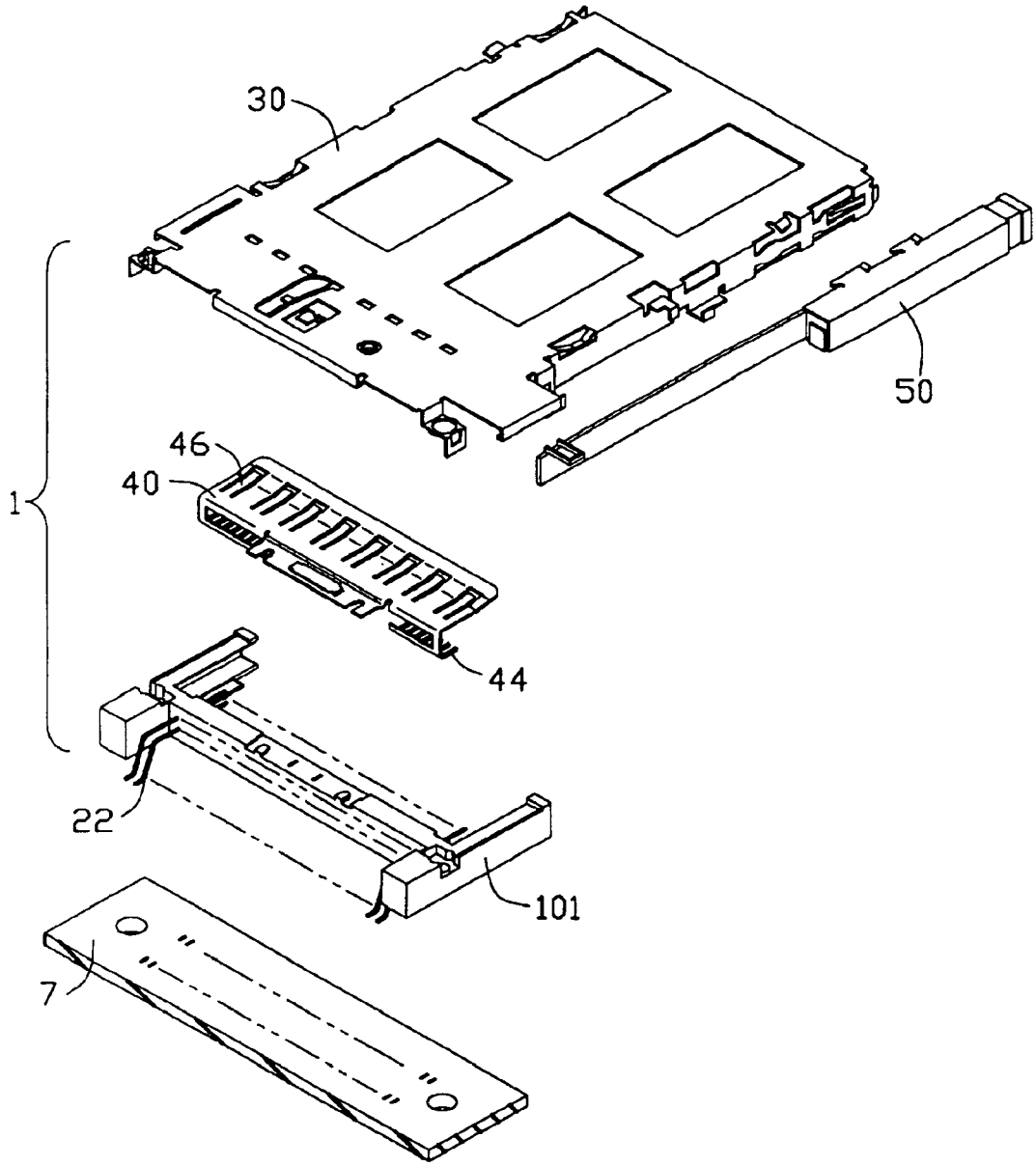
FIG. 1 (PRIOR ART)
FIG. 1 is an exploded, perspective view of a prior art electrical card connector.

Reference will now be made to the drawing figures to describe the present invention in detail.

Figure 2:
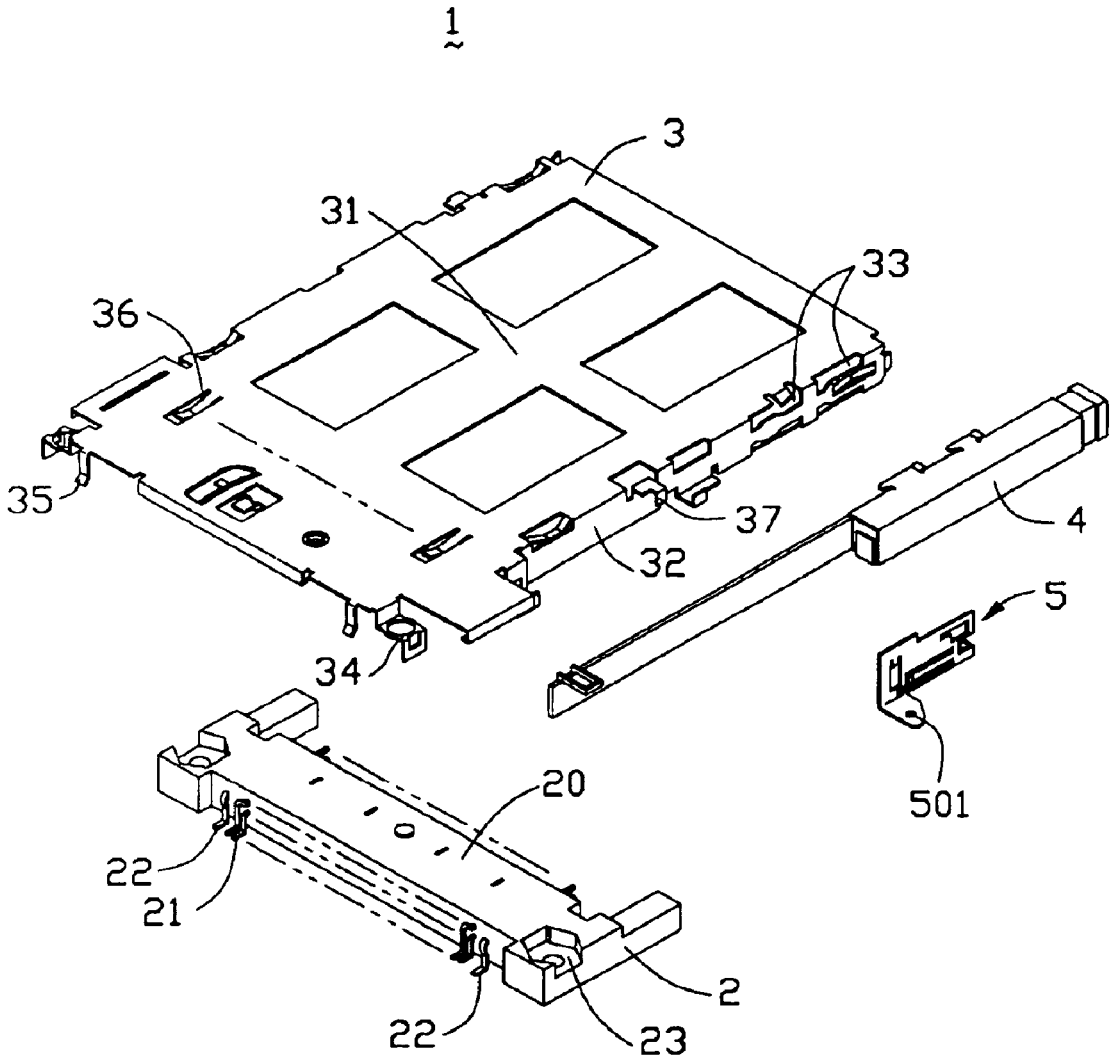
FIG. 2 is an exploded perspective view of an electrical card connector in accordance with the present invention.

With reference to FIG. 2, an electrical card connector 1 is mounted on a printed circuit board (not shown) and comprises an insulative housing 2, a plurality of contacts 21, 22 received in the insulative housing 2, a shell 3, an ejector 4, and a retention device 5.

The insulative housing 2 comprises a rectangular base 20 defining a plurality of passageways (not shown). The contacts 21, 22 are received in the passageways. The contacts comprise a plurality of signal contacts 21 and a pair of grounding contacts 22. The grounding contacts 22 are respectively positioned at two outer sides of the signal contacts 21. The base 20 defines a pair of recesses 23 at opposite sides thereof.

Figure 3:
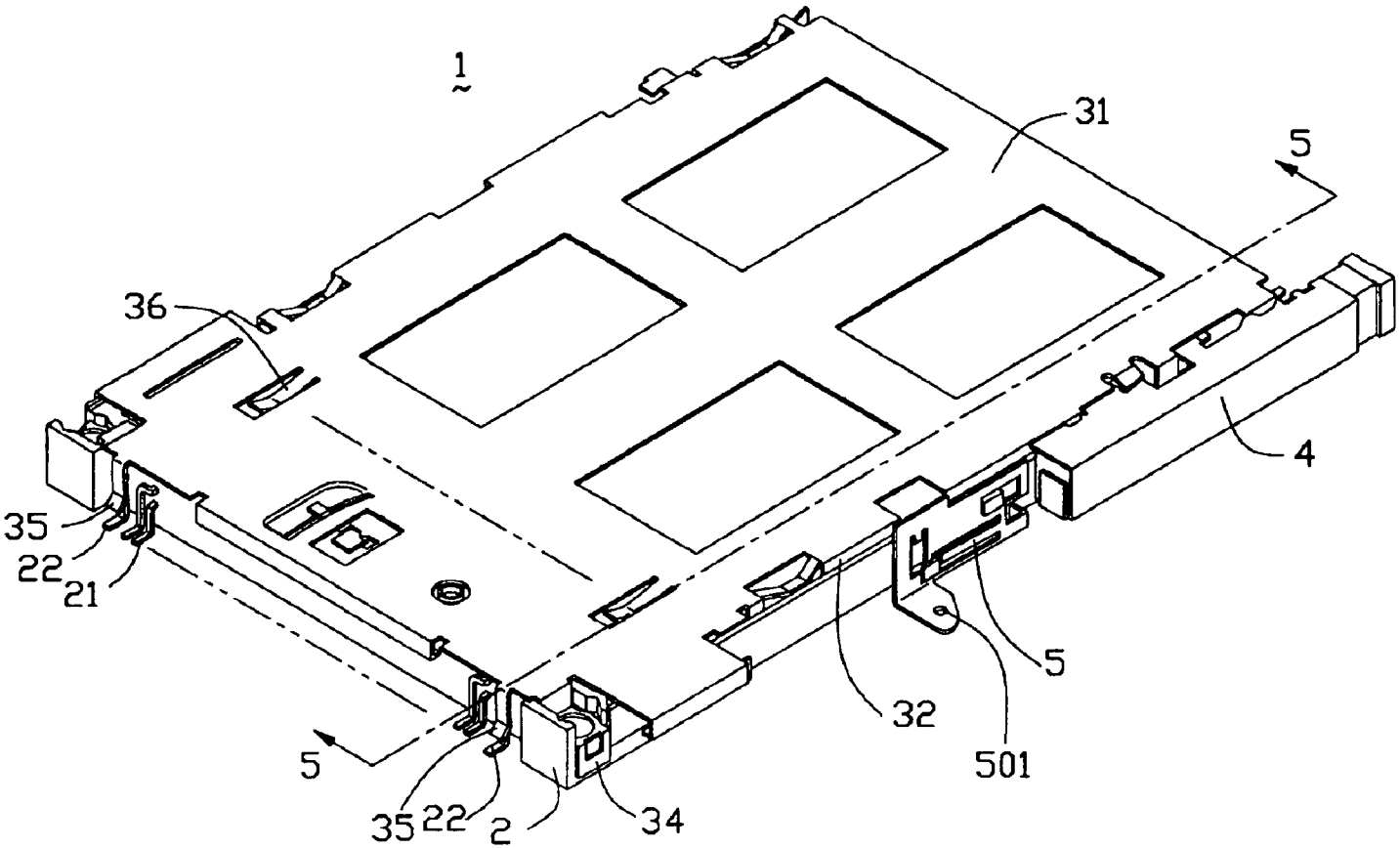
FIG. 3 is an assembled, perspective view of the electrical card connector shown in FIG. 2.
Figure 4:
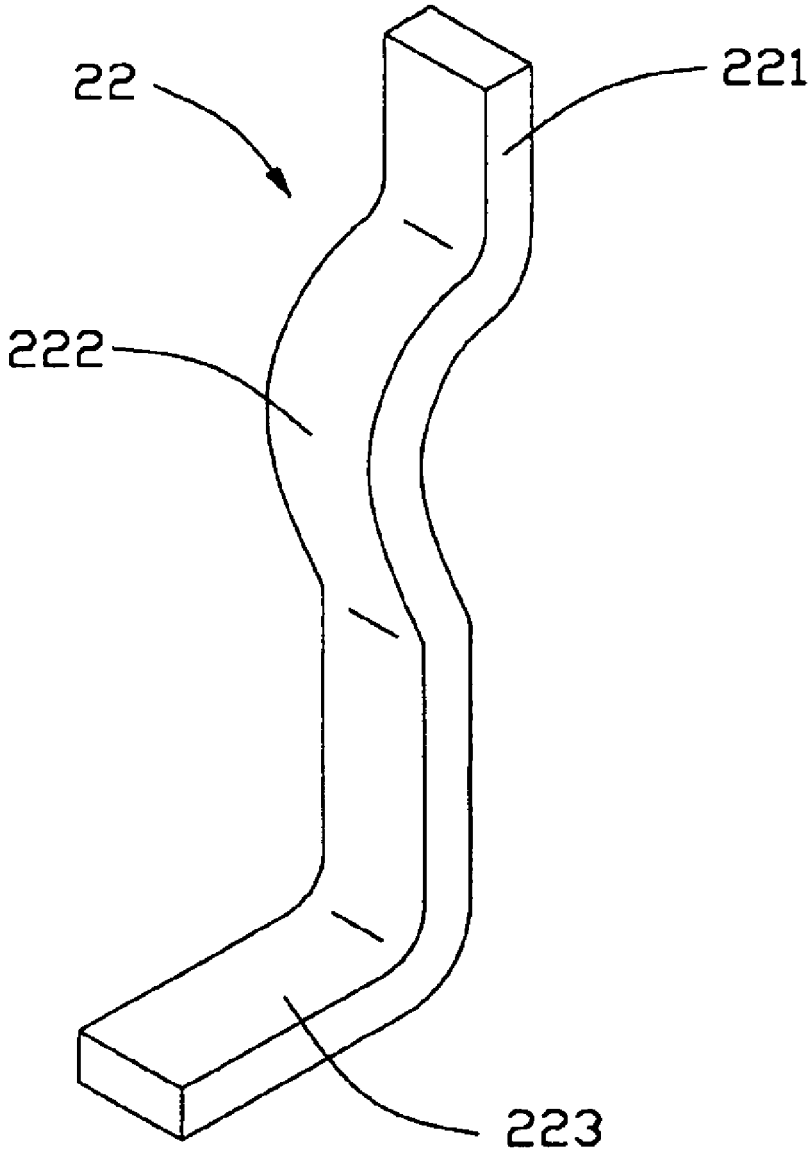
FIG. 4 is an enlarged view of a grounding contact of the electrical card connector of FIG. 3.

Referring to FIGS. 3 and 4, each grounding contact 22 comprises an engagement portion 222 (in this embodiment is a curved portion), an engaging portion 221 extending forwardly from the curved portion 222 and insert-molded with the insulative housing 2, and a mounting portion 223 extending downwardly and bent rearwardly from the curved portion 222.

Referring to FIG. 2, the shell 3 is made from a metal sheet and comprises a top wall 31, and opposite side walls 32 extending downwardly from the top wall 31. The cop and side walls 31, 32 together define a receiving space for receiving an electrical card (not shown). A connecting area between the top and side walls 31, 32 defines a plurality of cavities 33 and locking members 37 for securing the ejector 4 and the retention device 5. The cavities 33 and the locking member 37 of electrical card connectors are known in the art so that they will not be described here. A row of grounding plates 36 are positioned at a rear end of the top wall 31 and arranged parallel to each other. The grounding plates 36 are elastic and extend into the receiving space from the top wall 31. When the electrical card is inserted into the receiving space of the electrical card connector 1, the grounding plates 36 contact corresponding convex points on a surface of the electrical card for achieving an electrical connection. A pair of grounding portions 35 extend downwardly from the rear edge of the top wall 31. A pair of retention portions 34 extend downwardly from rear ends of the side walls 32.

Figure 5:
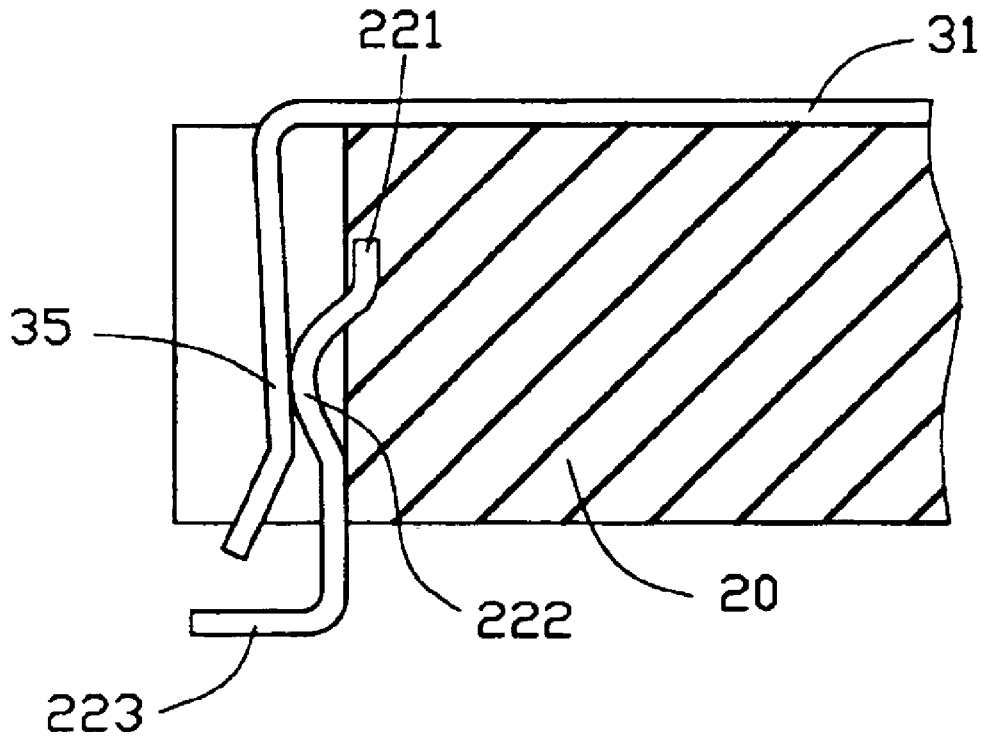
FIG. 5 is a cross-sectional view taken along line 5—5 of FIG. 3.

Referring to FIGS. 3 and 5, the shell 3 is assembled to the insulative housing 2, the retention portions 34 are mated with the recesses 23 of the insulative housing 2, and then a pair of screws (not shown) are inserted into the retention portions 34 and the recesses 23 for securing a connection between the insulative housing 2 and the shell 3. When the shell 3 is assembled to the insulative housing 2, the grounding portions 35 engage with the curved portions 222 of the grounding contacts 22 for achieving an electrical connection between the shell 3 and the grounding contacts 22.

The ejector 4 is secured in the side wall 32 through the cavities 33 and locking members 37. The retention device 5 is secured in the side wall 32 by the locking member 37, and a pair of bolts (not shown) are inserted into corresponding holes 501 for securing the retention device 5 on the PCB. The ejector 4 and the retention device 5 are also prior art themselves, and thus will not be further described here.

In electrical card connector 1 of the present invention, the grounding plates 36 of the top wall 31 contact the surface of the electrical card received in the electrical card connector 1 for making an electrical connection. The grounding contacts 22 electrically connect with corresponding grounding path on the PCB, and the grounding portions 35 of the shell 3 electrically connect the grounding contacts 22 for grounding. When the electrical card connector 1 is mounted on the PCB, the mounting portions 223 of the signal and grounding contacts 21, 22 are mounted on the PCB by Surface Mount Technology (SMT). In such a way, the process of assembly is convenient and effectively reduces occupied space on the PCB so as to meet the miniature requirements for portable computers.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical card connector comprising:

an insulative housing defining a plurality of passageways extending therethrough;

a plurality of signal contacts received in the passageways;

a pair of grounding contact being positioned at a rear end of the insulative housing and each having a curved portion;

a shell assembled to the insulative housing and comprising a top wall, opposite side walls, and a pair of grounding portions extending downwardly from a rear edge of the top wall and connecting with the curved portions of the grounding contacts, the top wall and the opposite side walls together defining a receiving space for receiving an electrical card wherein the shell defines a number of grounding plates on a rear end of the top wall;

wherein the grounding contact comprises an engaging portion extending forwardly from the curved portion and insert-molded with the insulative housing, and a mounting portion extending downwardly and bent rearwardly from the curved portion;

wherein the insulative housing defines two recesses at two sides thereof, and the shell defines a pair of retention portion corresponding to the recesses, the recesses securely mating with the retention portions; the electrical card connector further comprising an ejector secured in the side wall of the shell and a retention device secured in the side wall of the shell; and wherein the grounding contacts are arranged at outer sides of signal contacts.

2. An electrical card connector comprising:

an insulative housing defining a plurality of passageways extending therethrough;

a plurality of signal contacts received in the passageways;

at least one grounding contact being positioned at a rear end of the insulative housing and having an engagement portion;

a shell assembled to the insulative housing and comprising a top wall, and at least one grounding portion extending downwardly from the top wall and abutting against the engagement portion of the grounding contacts; wherein one of the engagement portion and the grounding portion is in an immoveable manner and defines a curved configuration which is engaged with the other of the engagement portion and the grounding portion, while the other of the engagement portion and the grounding portion is essentially in a deflectable manner wherein said grounding contact extends through said housing similar to said signal contacts, and wherein said one of the engagement portion and the grounding portion is the engagement portion, and said other of the engagement portion and the grounding portion is the grounding portion.

* * * * *